US012004610B1

(12) United States Patent
Zhang

(10) Patent No.: US 12,004,610 B1
(45) Date of Patent: Jun. 11, 2024

(54) WATCH BAND

(71) Applicant: Meng Zhang, Shenzhen (CN)

(72) Inventor: Meng Zhang, Shenzhen (CN)

( * ) Notice: Subject to any disclaimer, the term of this patent is extended or adjusted under 35 U.S.C. 154(b) by 0 days.

(21) Appl. No.: 18/512,053

(22) Filed: Nov. 17, 2023

(51) Int. Cl.
*A44C 5/20* (2006.01)
*A44C 5/00* (2006.01)

(52) U.S. Cl.
CPC ..... *A44C 5/2042* (2013.01); *A44C 5/0069* (2013.01)

(58) Field of Classification Search
CPC ... A44C 5/0053; A44C 5/2042; A44C 5/0069; A44C 5/14; A44C 5/2071; A44C 5/18; A44C 5/185; A44C 5/20; A44C 5/22
USPC ..... 368/282; 224/176
See application file for complete search history.

(56) References Cited

U.S. PATENT DOCUMENTS 2,541,432 A * 2/1951 Muehlbauer ..... G04B 47/065 33/355 R
5,425,007 A * 6/1995 Walter ..... A44C 5/22 368/282

FOREIGN PATENT DOCUMENTS

DE 1906982 A1 * 2/1969
FR 2831777 A1 * 5/2003 ..... A44C 5/0053
GB 191504965 A * 3/1915
GB 432314 A * 5/1934

* cited by examiner

*Primary Examiner* — Jack W Lavinder
(74) *Attorney, Agent, or Firm* — Frank Niranjan

(57) ABSTRACT

A watch band includes a connector including a first hole and a second hole arranged at opposite ends thereof; a first band connected to the first hole, and a second band connected to the second hole. The first band includes a first connection member connected to an end of a wearable electronic device, a free end section and an extension section connected between the first connection member and the free end section. The second band includes a second connection member connected to another end of the wearable electronic device. The free end section is extendable through the first hole to be fastened to the extension section by VELCRO-type hook-and-loop fasteners. The free end section is provided with loops, the fixing layer is provided with hooks engageable with the loops. The length of the watch band is adjustable via adjusting engaging position of the free end section and the fixing layer.

19 Claims, 13 Drawing Sheets

WATCH BAND

FIELD

The present invention relates to the technical field of securement of wearable devices, and more particularly, to watch bands.

BACKGROUND

A wristwatch can be attached to a user's wrist by a watchband wrapping around the wrist. In order to fit different users with different wrist sizes, a watch band with a user-adjustable size is desired. In addition, comfort of the user is a key issue when designing a watch band.

SUMMARY

In one aspect, the present invention provides a watch band which comprises a connector comprising a first hole and a second hole arranged at opposite ends thereof; a first band connected to the first hole of the connector, and a second band connected to the second hole of the connector. The first band comprises a first connection member configured for being connected to an end of a wearable electronic device, a free end section and an extension section connected between the first connection member and the free end section. The second band comprising a second connection member configured for being connected to another end of the wearable electronic device. The free end section of the first band is extendable through the first hole of the connector to be fastened to the extension section of the first band by hook-and-loop fasteners such as VELCRO-type hook-and-loop fasteners. The length of the watch band is adjustable via adjusting engaging position of the free end section and the fixing layer.

Preferably, the free end section has a width less than that of the extension section.

Preferably, the extension section comprises a base layer and a fixing layer for engaging with the free end section, the fixing layer being fixed on a side of the base layer and having a width less than that of the base layer.

Preferably, the first band further comprises a connecting section fixed on the base layer and opposite to the free end section of the fixing layer, the connecting section defines a connecting slot, and the first connection member extends through the connecting slot.

In some embodiments, the connecting section comprises a decoration part and a clamping part which has two layers stacked together, the connecting slot is formed between the two layers of the clamping part, free ends of the two layers of the clamping part and the decoration part are stacked on the base layer in sequence and fixed to the base layer by sewing, and the first connection member comprises a post which extends through the connecting slot.

In some embodiments, the connecting section comprises a clamping part, a mounting part, a decoration part, the clamping part has two layers stacked together, the connecting slot is formed between the two layers of the clamping part, free ends of the two layers of the clamping part, the mounting part and the decoration part are stacked on the base layer in sequence and fixed to the base layer by sewing, and the first connection member comprises a spring bar which extends through the connecting slot.

Preferably, the fixing layer comprises a connecting slot, and the first connection member comprises a connection post extending through the connecting slot.

Alternatively, the fixing layer comprises a connecting slot, and the first connection member comprises a spring bar extending through the connecting slot.

Preferably, the width of the free end section is substantially equal to or slightly less than that of the fixing layer.

Preferably, opposite sides of the base layer extend respectively beyond opposite sides of the fixing layer in a width direction of the first band.

Alternatively, opposite ends of the base layer extend respectively beyond opposite ends of the fixing layer in a length direction of the first band.

Preferably, the first hole has a width substantially equal to that of the base layer of the extension section of the first band.

Preferably, the base layer is made of cloth and the fixing layer is fixed to the base layer by sewing.

Preferably, opposite sides of the fixing layer in a width direction of the first band are fixed to opposite sides of the base layer by sewing.

Preferably, the second band comprises a base layer and a connection layer which is fixed on a side of the base layer of the second band and has a width less than that of the base layer of the second band; and the connection layer comprises an end connected to the second connection member and an opposite end connected to the second hole of the connector.

In some embodiments, the width of the connection layer of the second band is equal to that of the fixing layer of the extension section of the first band.

In some embodiments, the width of the base layer of the second band is equal to that of the base layer of the extension section of the first band.

In some embodiments, the width of the connection layer of the second band is equal to or less than that of the second hole of the connector.

In some embodiments, the width of the base layer of the second band is greater than that of the second hole of the connector.

In some embodiments, the base layer and the connection layer both are made of one or more of cloth, nylon, fabric, polyester cotton, dacron and leather.

In some embodiments, the connection layer comprises a pair of connecting slots formed at the end and the opposite end respectively; the second connection member comprises a connection post or a spring bar extending through one of the connecting slots; and an edge of the second hole extends through the other of the connecting slots.

In some embodiments, the free end section is provided with loops, the fixing layer is provided with hooks engageable with the loops.

In some embodiments, the first hole has a width greater than that of the second hole.

In another aspect, the present invention provides a watch band which comprises a band; and a connector configured to connect the band to a wearable electronic device. The connector comprises a hole. The band comprises a connection member configured for being connected to an end of the wearable electronic device, a free end section and an extension section connected between the first connection member and the free end section. The extension section comprises a base layer and a fixing layer. The free end section is extendable through the hole of the connector to be fastened to the fixing layer of the extension section.

In some embodiments, the watch band further comprises another band. The connector further comprises another hole and a pair of side walls extending along a length direction the watch band, each of the side walls having a curved inner surface for contacting with a user's wrist. The another band comprises a first end configured to be connected to an opposite end of the wearable electronic device, and a second end connected to the another hole of the connector.

BRIEF DESCRIPTION OF THE DRAWINGS

The invention will be further described below in conjunction with accompanying drawings and embodiments. In the drawings.

Figure 1:
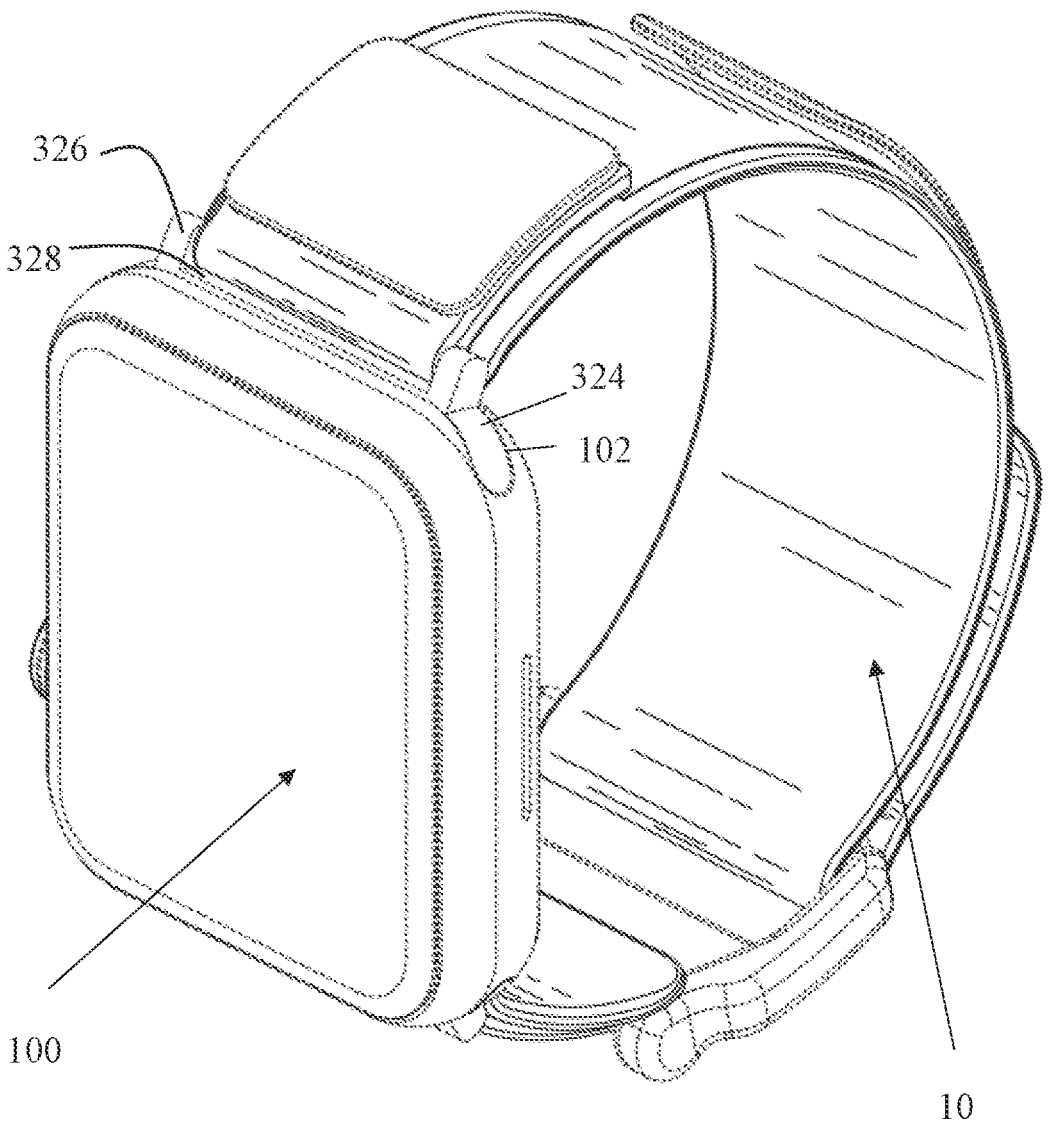
FIG. 1 illustrates a watch band in accordance with an embodiment of the present invention connected to opposite ends of a wearable electronic device.
Figure 2:
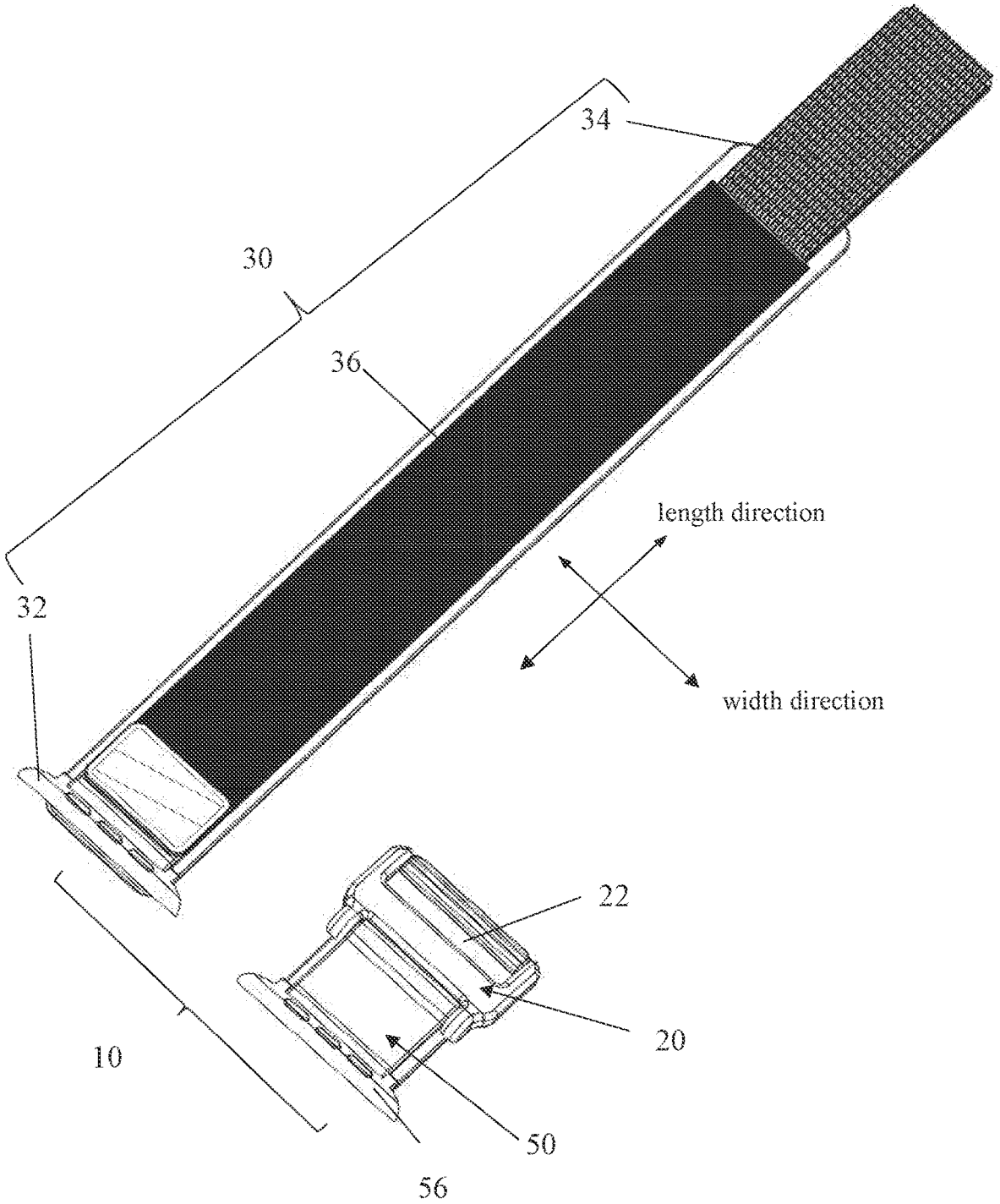
FIG. 2 is a partly exploded view of the watch band of FIG. 1, the watch band comprising a connector, a first band and a second band.

Numerals in the drawings: watch band 10/10', connector 20, first hole 22, second hole 24, connection beam 26, first band 30, first connection member 32/32', connecting post 322/562, connection portion 324/562, leg 326, opening 328, free end section 34, loops 342, extension section 36, base layer 362/52, fixing layer 364, hooks 3642, connecting slot 3644/542, second band 50, connection layer 54, second connection member 56/56', wearable electronic device 100/100'

DESCRIPTION OF THE EMBODIMENTS

To gain a better understanding of the technical features, purposes and effects of the invention, specific implementations of the invention are described in detail with reference to the accompanying drawings.

When one element is referred to as being "fixed to" or "arranged on" the other element, it may be directly or indirectly located on the other element. When one element is referred to as being "connected to" the other element, it is directly or indirectly connected to the other element.

Terms such as "upper", "lower", "left", "right", "front", "back", "vertical", "horizontal", "top", "bottom", "inner" and "outer" are used for indicating directions or positions based on the accompanying drawings merely for the purpose of description, and should not be construed as limitations of the technical solutions of the invention. Terms such as "first" and "second" are merely for the purpose of facilitating description, and should not be construed as indicating or implying relative importance or implicitly indicating the number of technical features referred to. Unless other expressly and specifically stated, "multiple" and "a plurality of" refer to two or more.

FIG. 1 shows a watchband 10 connected to opposite ends of a wearable electronic device 100, such as a wristwatch or a health tracking device, which can be attached to a user's wrist by the watch band 10 wrapping around the user's wrist.

Referring to FIG. 1-FIG. 8, the watch band 10 in accordance with an embodiment of the present invention comprises a connector 20 comprising a first hole 22 and a second hole 24 arranged at opposite ends thereof in a length/longitudinal direction of the watch band 10, a first band 30 connected to the first hole 22 of the connector 20 and a second band 50 connected to the second hole 24 of the connector 20.

Figure 8:
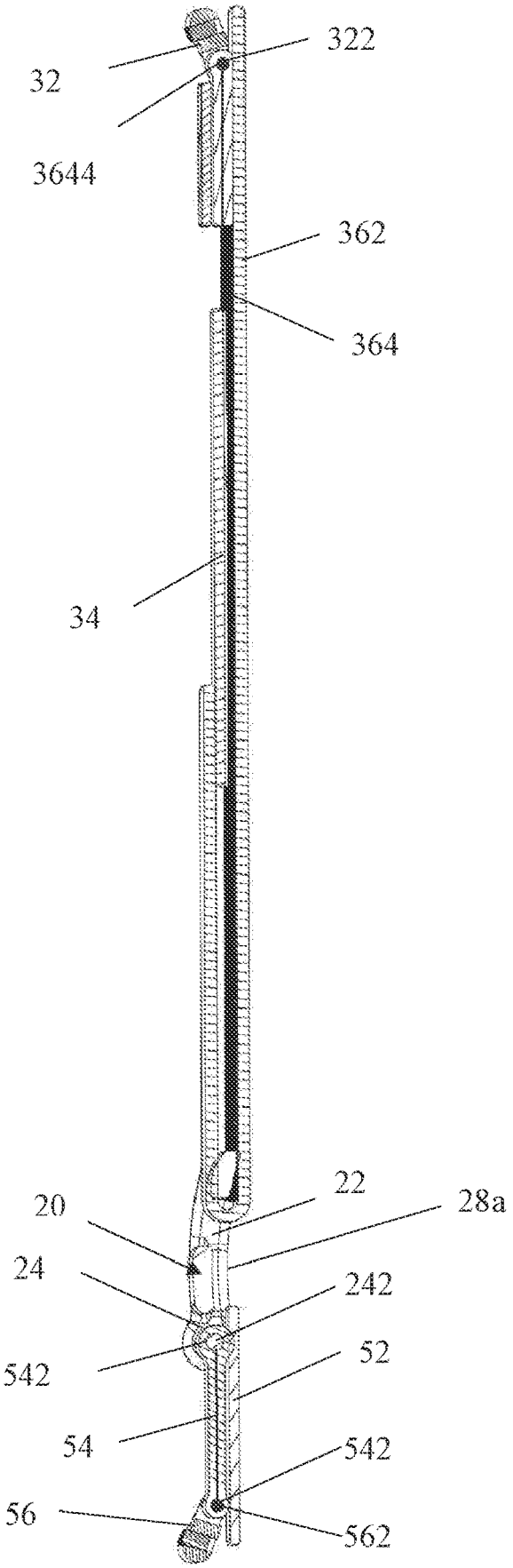
FIG. 8 is a cross-sectional view of FIG. 6.
Figure 9:
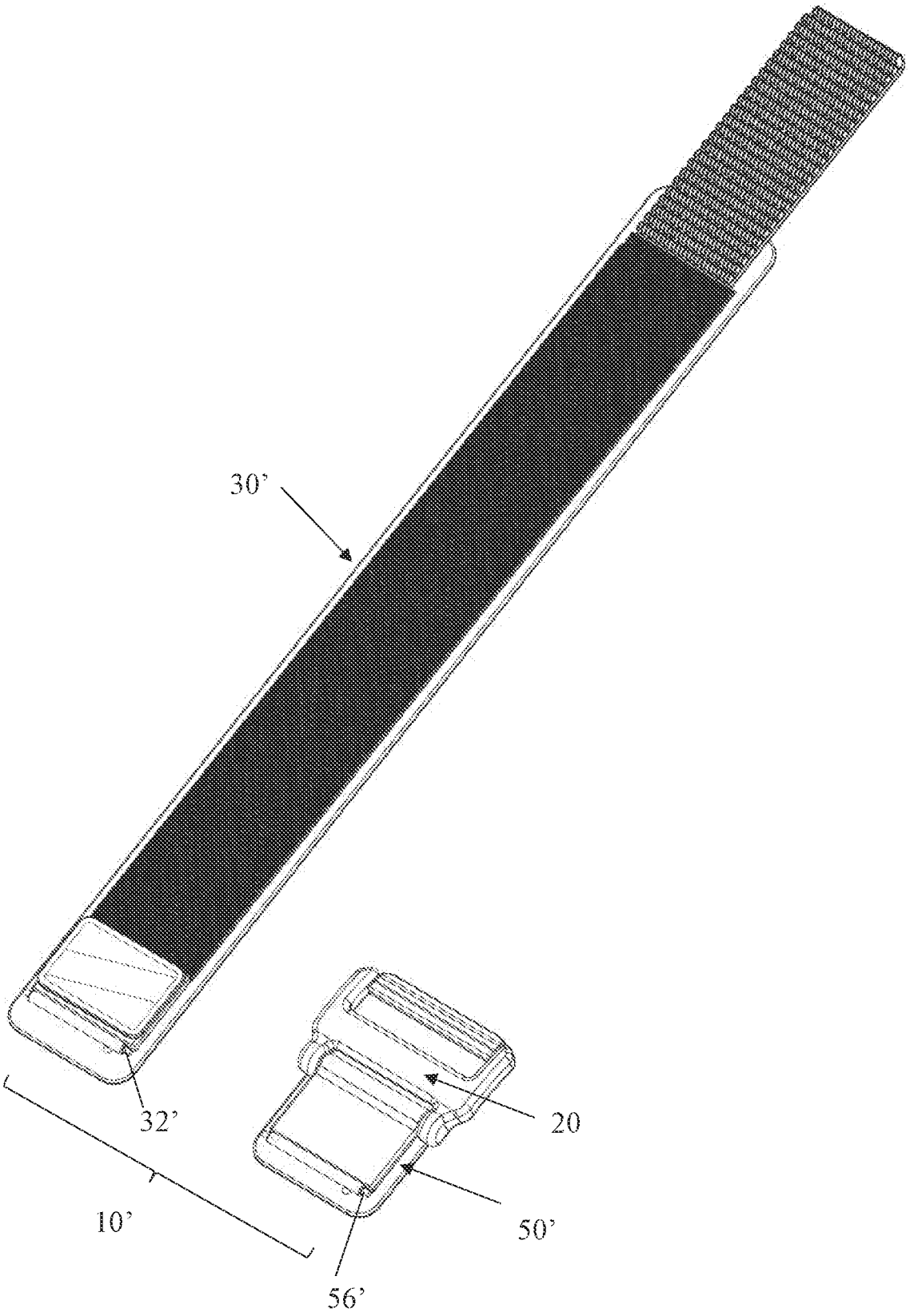
FIG. 9 illustrates a watch band in accordance with an alternative embodiment of the present invention.
Figure 10:
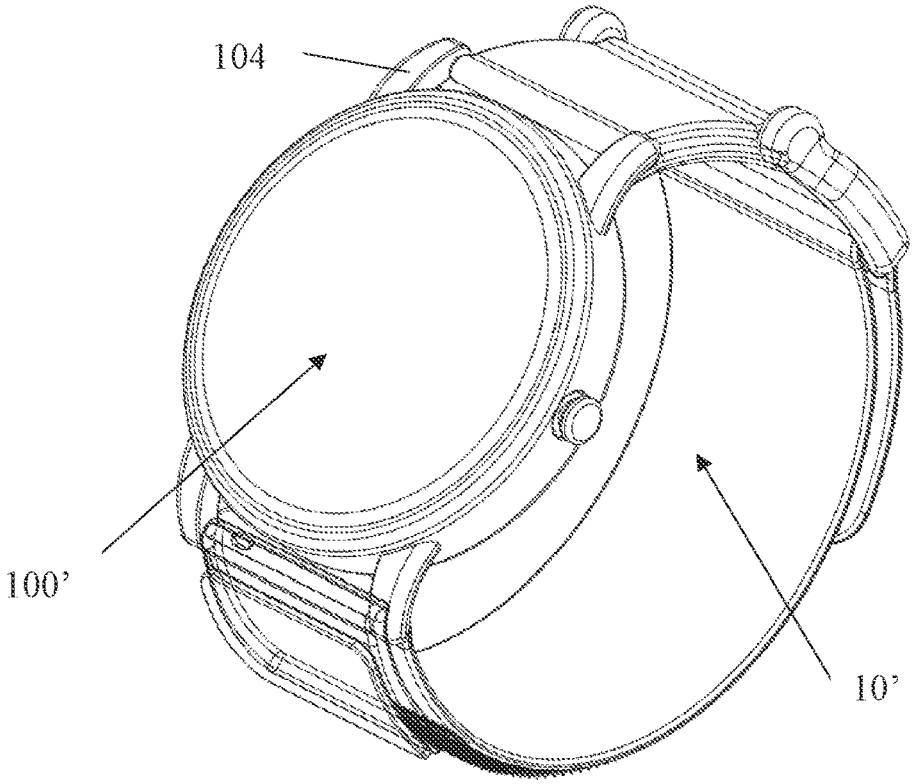
FIG. 10 illustrates the watch band of FIG. 8 connected to opposite ends of a wearable electronic device.
Figure 11:
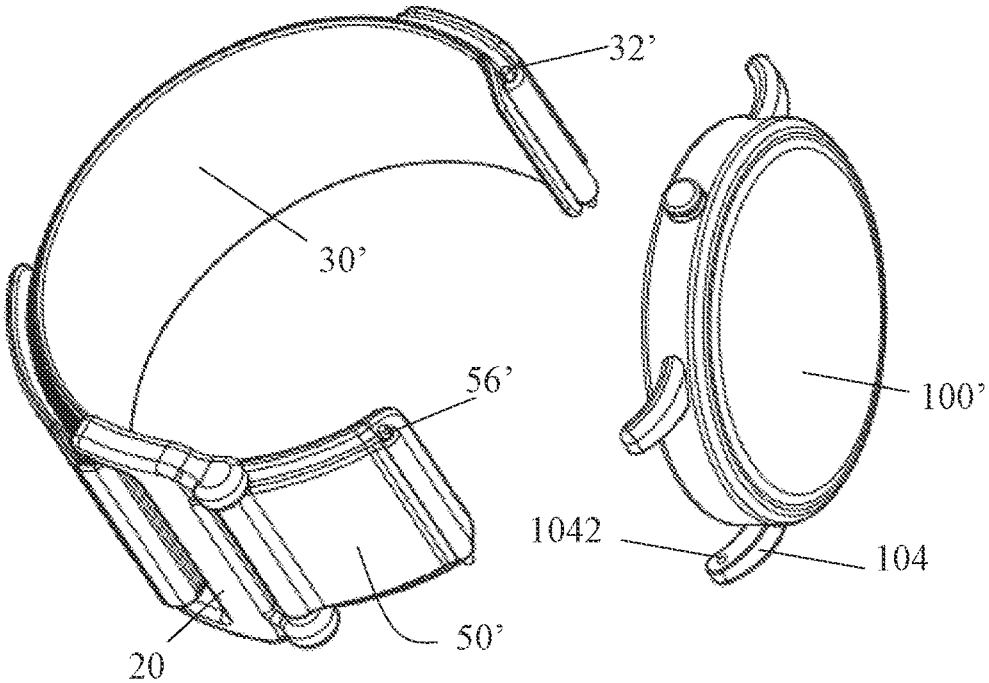
FIG. 11 is an exploded view of FIG. 10.
Figure 12A:
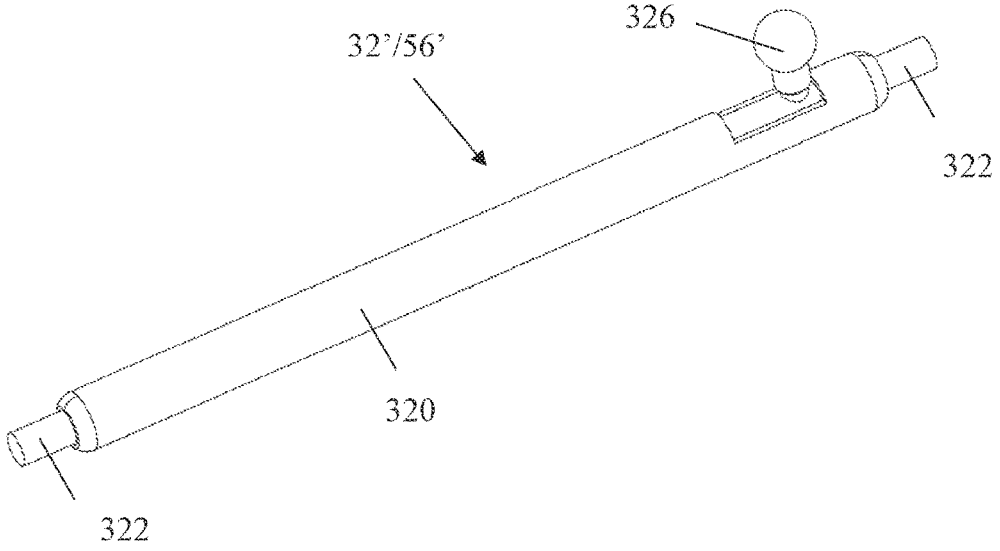
FIG. 12A illustrates a spring bar applied in the watch band of FIGS. 9-11.
Figure 12B:
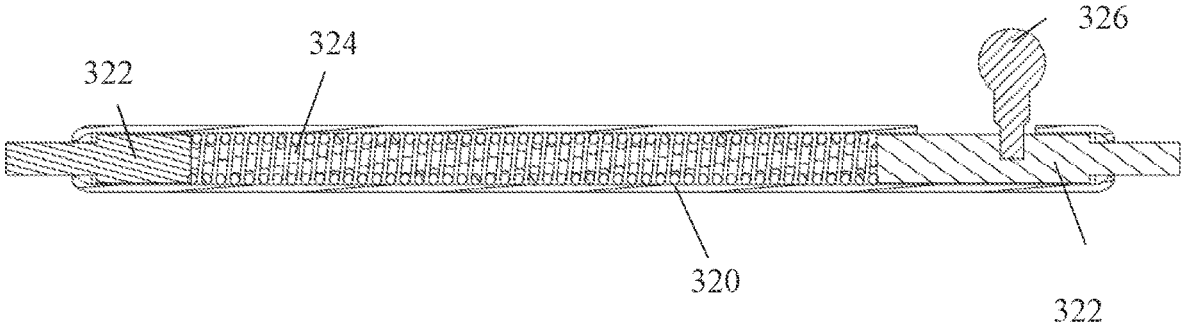
FIG. 12B is a cross-sectional view of FIG. 12A.
Figure 13:
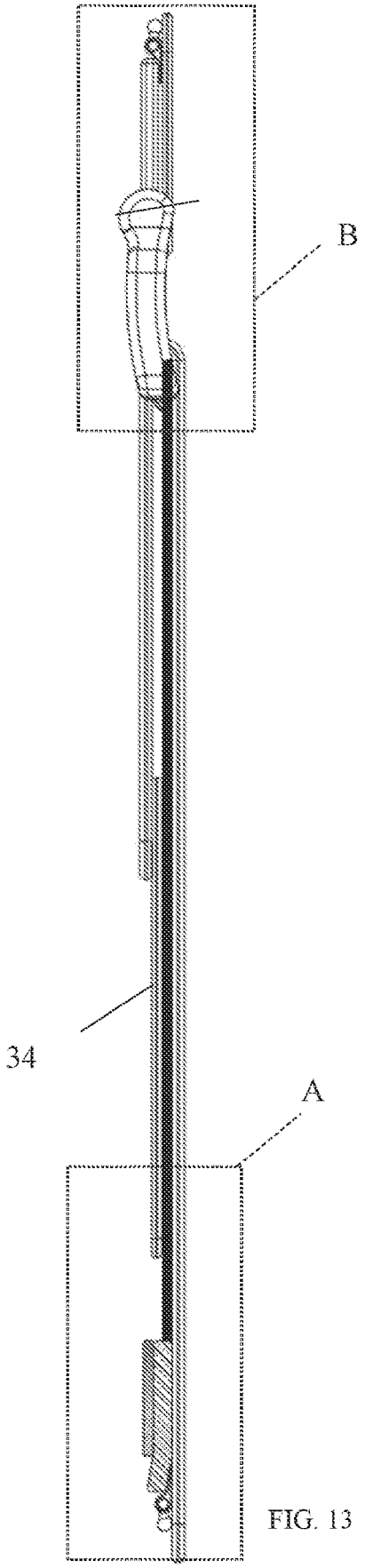
FIG. 13 is a cross-sectional view of the watch band of FIG. 11 in an unfolded state.
Figure 13A:
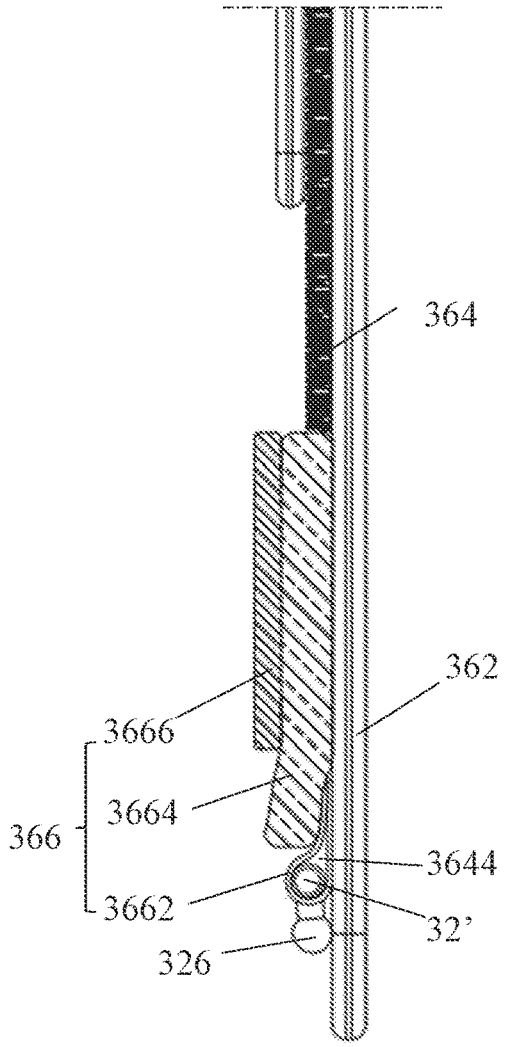
FIG. 13A and FIG. 13B are respectively enlarged view of circled portions A and B of FIG. 13.
Figure 13B:
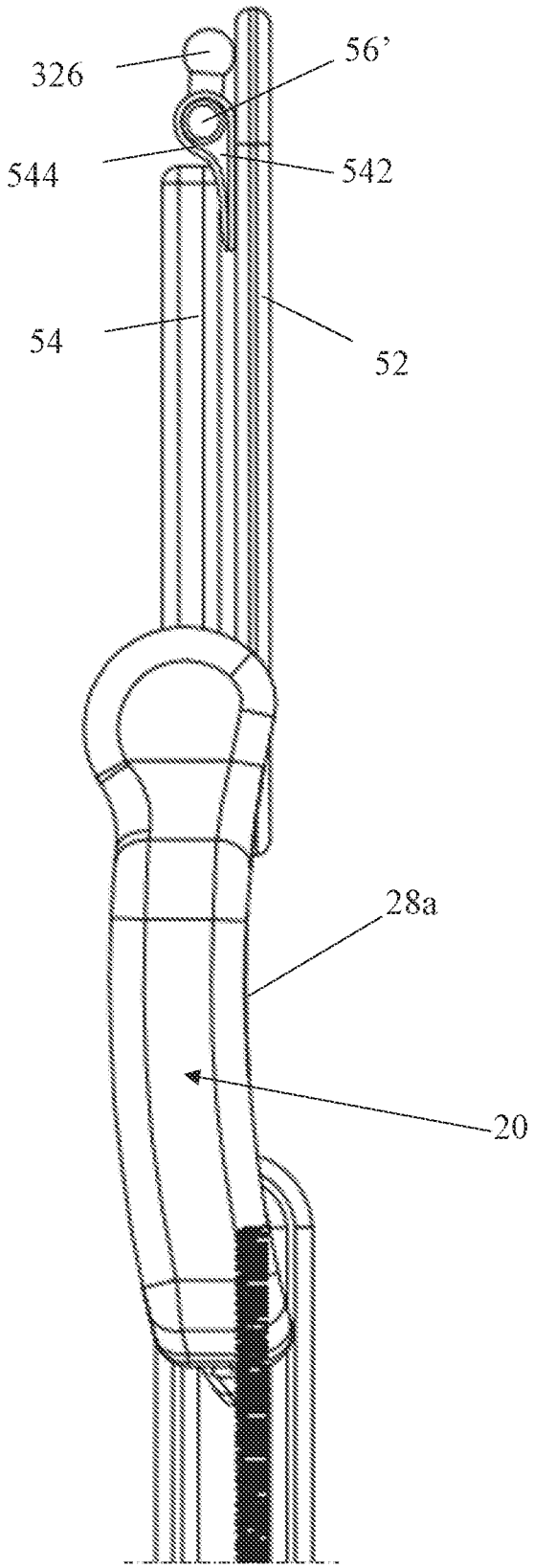

The connector 20 further comprises a connection beam 26 located between the first hole 22 and the second hole 24, and a pair of side walls 28 extending in the length direction of the watch band 10. The connection beam 26 extends between the side walls 28 in a width/transverse direction of the watch band 10. The first hole 22 and the second hole 24 are enclosed holes, which means the holes having enclosed circumferential edges surrounding the holes. Referring to FIGS. 8, 13 and 13B, the side walls 28 of the connector 20 have inner surfaces 28*a* configured to contact with the user's wrist. Preferably, the inner surfaces 28*a* are curved for fitting with the user's wrist better. The connector 20 may be made of metal or plastic material.

The first band 30 comprises a first connection member 32 configured for being connected to an end of a wristwatch or a health tracking device, a free end section 34 and an extension section 36 connected between the first connection member 32 and the free end section 34. The free end section 34 is extendable through the first hole 22 to be fastened to the extension section 36 by VELCRO-type hook-and-loop fasteners, which facilitates to provide a user-adjustable size.

Referring to FIGS. 2 and 4-8, the extension section 36 is flexible and comprises a base layer 362 and a fixing layer 364 for engaging with the free end section 34. The base layer 362 is configured for contacting with the user's wrist. The base layer 362 defines a length direction extending from one of the first connection member 32 and the free end section 34 toward the other of the first connection member 32 and the free end section 34, a width direction perpendicular to the length direction, and a depth direction perpendicular to both the length direction and the width direction. When the electronic device 100 is attached to the user's wrist by the watch band 10, the length direction of the base layer 362 or the length direction the watch band extends along the circumference of the user's wrist.

Preferably, the length of the base layer 362 is much greater than the width of the base layer 362 which is much greater than the depth of the base layer 362.

The fixing layer 364 is attached on one side of the base layer 362 in the depth direction away from the user's wrist. The base layer 362 has a width greater than that of the fixing layer 364, which facilitates to increase the comfort of the user while wearing the electronic device 100. Preferably, opposite sides of the base layer 362 extend respectively beyond opposite sides of the fixing layer 364 in the width direction. More preferably, opposite sides of the base layer 362 extend respectively beyond opposite sides of the fixing layer 364 in the width direction by 1-5 mm, such as 1 mm, 1.5 mm, 2 mm, 2.5 mm, 3 mm, 3.5 mm, 4 mm, 4.5 mm, 5 mm.

In some embodiments, opposite ends of the base layer 362 extend respectively beyond opposite ends of the fixing layer 364 in the length direction, which facilitates to increase the comfort of the user while wearing the electronic device 100.

In some embodiments, the base layer 362 may be made of cloth, nylon, fabric, polyester cotton, dacron, leather etc. The fixing layer 364 may be fixed to the base layer 362 by sewing. Preferably, opposite sides of the fixing layer 364 in the width direction are fixed to the base layer 362 by sewing. Understandably, the fixing layer 364 may be fixed to the base layer 362 by other means, such as by an adhesive layer.

In some embodiments, the fixing layer 364 is provided with a plurality of hooks 3642 and the free end section 34 is provided with a plurality of loops 342 which are engageable with the hooks 3642 of the fixing layer 364. The effective length of the watch band is adjustable via adjusting engaging position of the free end section 34 and the fixing layer 364. An end of the free end section 34 is fixed to one end of the base layer 362 away from the first connection member 32 by sewing or other ways of fastening. The other end of the free end section 34 extends beyond the one end of the base layer 362 in a direction parallel to the length direction of the extension section. The free end section 34 and the fixing layer 364 are attached to the same side of the base layer 362. The free end section 34 is close to or in contact with the end of the fixing layer 364 away from the first connection member 32. Preferably, the width of the free end section 34 is substantially equal to or slightly less than that of the fixing layer 364 of the extension section 36. The width of the extension section 36 is defined by the width of the base layer 362 of the extension section 36. The width of the free end section 34 is less than that of the base layer 362 of the extension section 36 (i.e., the width of the extension section 36).

Figure 5:
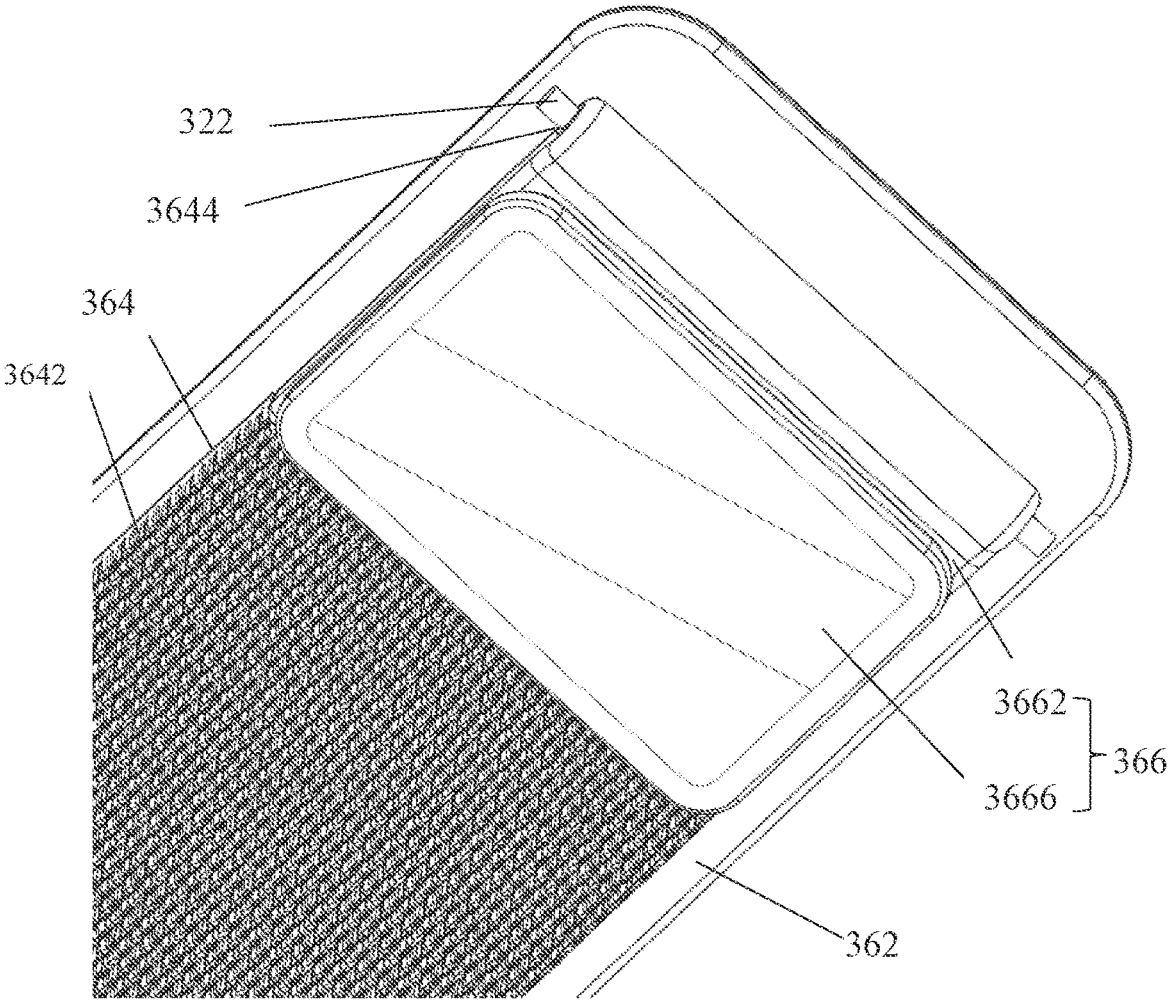
FIG. 5 is an enlarged view of a portion of a first connection member of the first band and another end of an extension section of the first band of FIG. 2.
Figure 5A:
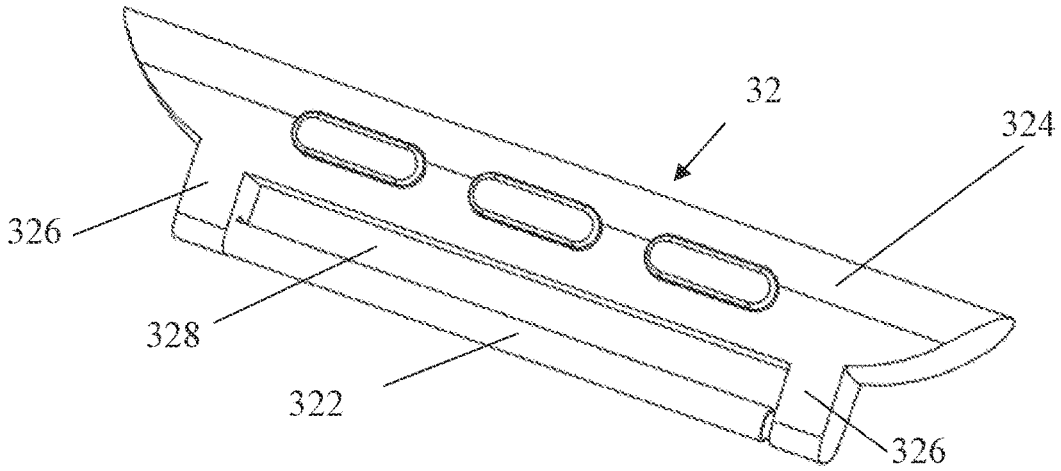
FIG. 5A is a perspective view the first connection member of the first band of FIG. 2.
Figure 6:
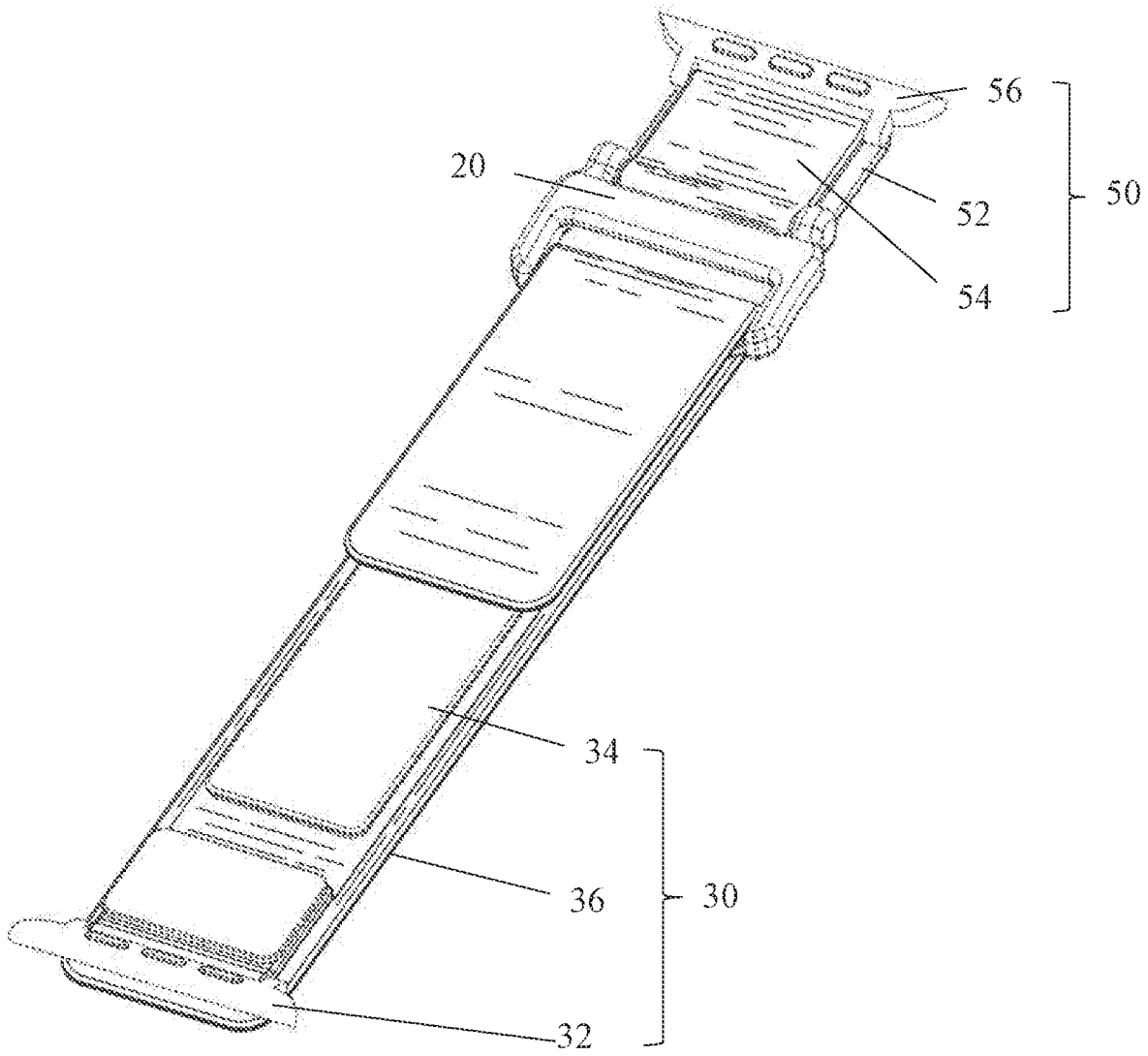
FIG. 6 is an assembled perspective view of the watch band of FIG. 2.
Figure 7:
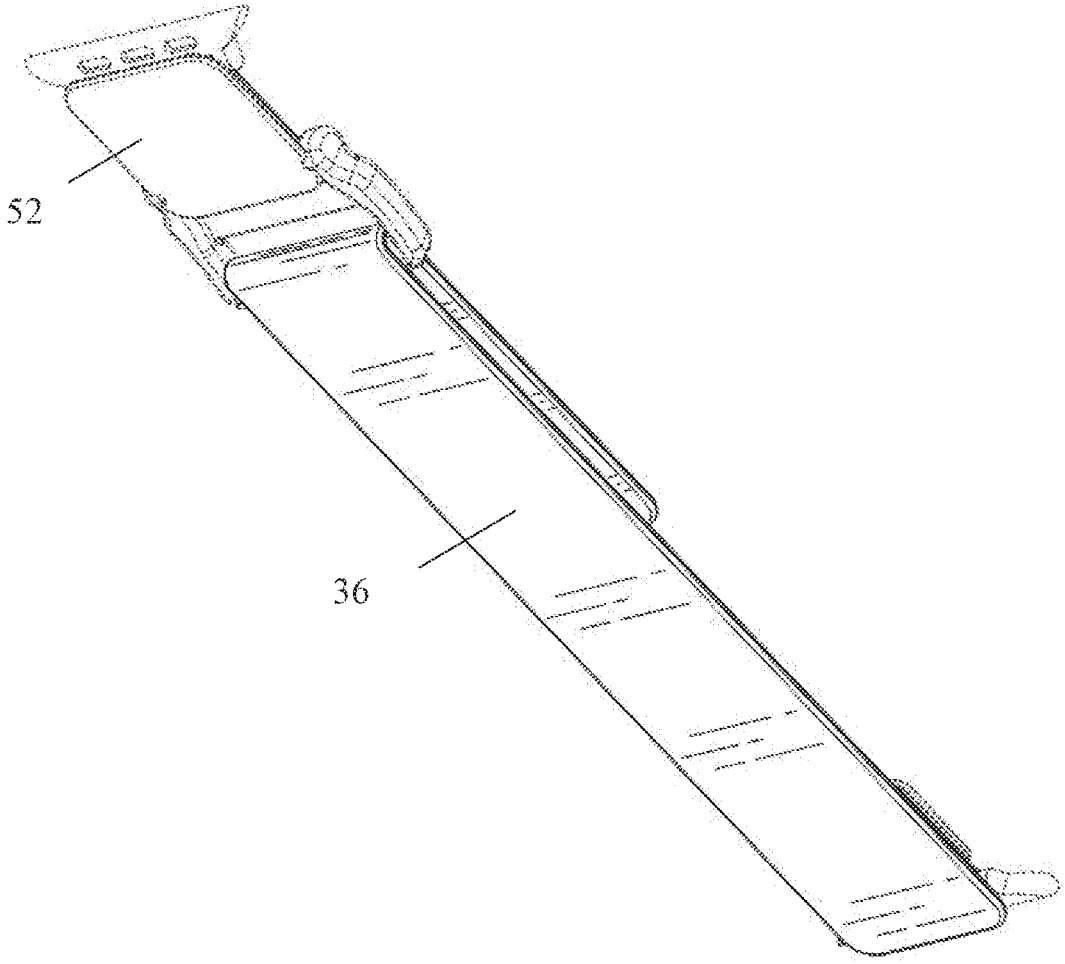
FIG. 7 is similar to FIG. 6 but viewed from another aspect.

The first band further comprises a connecting section 366 fixed on the base layer 362 and opposite to the free end section 34. The first connection member 32 is connected to the connecting section 366. Specifically, the end of the connecting section 366 is provided with a connecting slot 3644. The first connection member 32 comprises a connecting post 322 extending through the connecting slot 3644, as shown in FIG. 5 and FIG. 8. Referring to FIG. 5A, more specifically, the first connection member 32 further comprises a connecting portion 324 configured for being inserted into one of connection grooves 102 (FIG. 1) of the wearable electronic device 10, a pair of legs 326 extend from opposite ends of the connecting portion 324. Opposite ends of the connecting post 322 are connected to the legs 326 respectively. An opening 328 is formed among the connecting portion 324, the connecting post 322 and the legs 326. The connecting section 366 comprises a clamping part 3662 and a decoration part 3666. The clamping part 3662 has two layers stacked together, the two layers are formed by folding a layer of material of the clamping part 3662 and the connecting slot 3644 is formed at the bent/folded area, i.e., the connection area of the two layers of the clamping part 3662. In assembly, a free end of the clamping part 3662 may extend through the opening 328. Then, free ends of the two layers of the clamping part 3662 and the decoration part 3666 are stacked on the base layer 362 and fixed to the base layer 362 by sewing. The connecting post 322 extends through the connecting slot 3644. The distal end of the fixing layer 364 away from the free end section 34 may be sandwiched and fixed between the two layers of the clamping part 3662 and the base layer 362.

The end of the fixing layer 364 away from the free end section 34 may be inserted through the opening 328, folded around the connecting post 322, and then overlapped to a part of the fixing layer 364 with the connecting slot 3644 being formed therebetween for receiving the connecting post 322. The end of the fixing layer 364 passing through the opening 328 may be fixed to the part of the fixing layer 364 by sewing. Thus, the first connection member 32 is connected to the first band 30 and pivotable about the connecting post 322. Preferably, the end of the base layer 362 away from the free end section 34 may extend beyond the connecting post 322 and the legs 326 in both the length direction of the extension section 36 and the width direction of the extension section 36. Alternatively, the end of the base layer 362 away from the free end section 34 may be flush with the legs 326 in the width direction of the extension section 36. The end of the base layer 362 away from the free end section 34 may be flush with the connecting portion 324 in the length direction of the extension section 36 or the connecting portion 324 extend beyond the end of the base layer 362 away from the free end section 34 in the length direction of the extension section 36.

Referring to FIG. 1, in some embodiments, the wearable electronic device 100 is provided with a pair of connection grooves 102 at opposite ends thereof. The connecting portion 324 of the first connection member 32 may be inserted into one of the connection grooves 102 of the wearable electronic device 10 to thereby connect the first band to the wearable electronic device 100.

Figure 3:
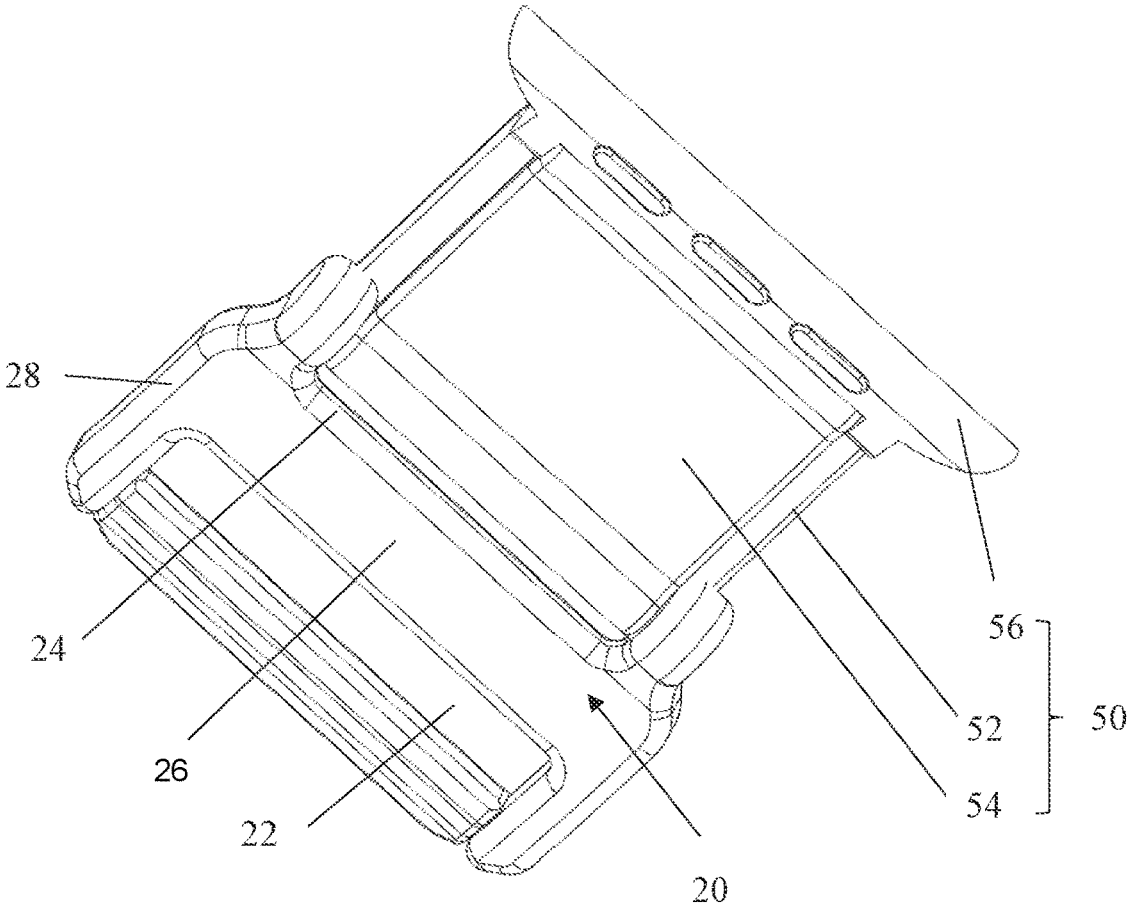
FIG. 3 is an enlarged view of the connector and the second band of FIG. 2.
Figure 3A:
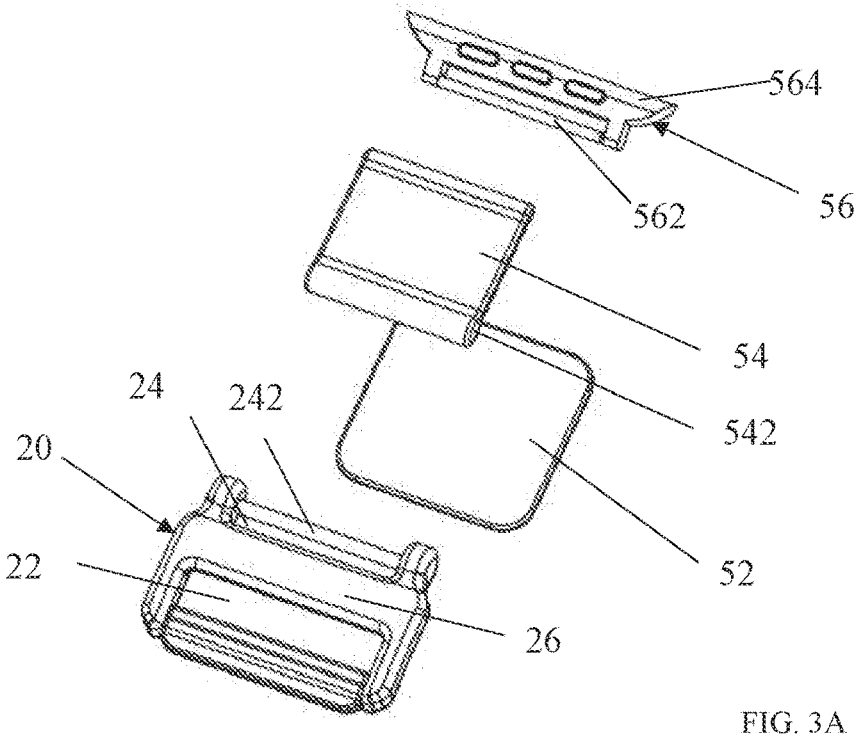
FIG. 3A is an exploded view of FIG. 3.
Figure 4:
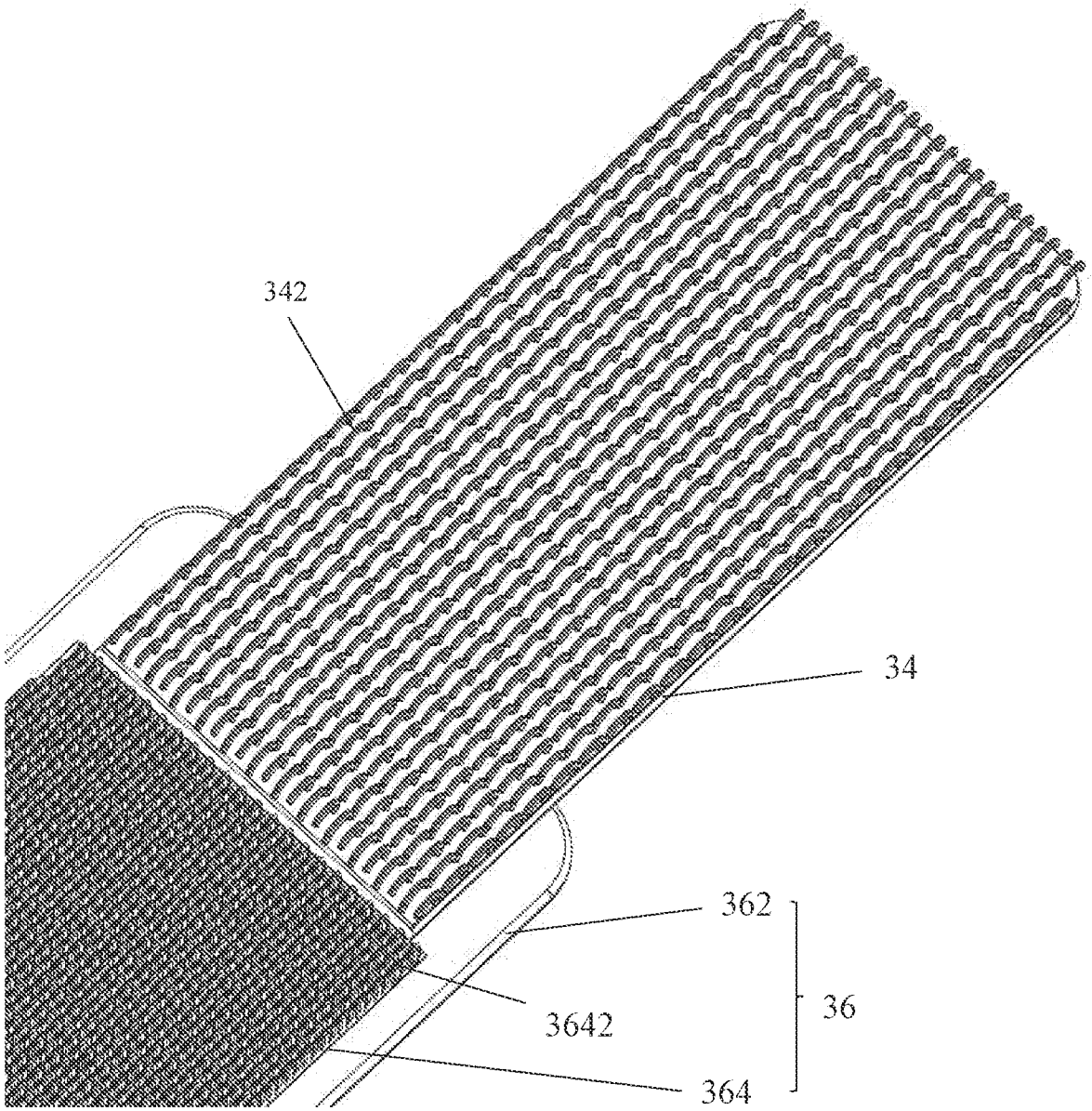
FIG. 4 is an enlarged view of a free end section of the first band and an end of an extension section of the first band of FIG. 2.

Referring to FIG. 3 and FIG. 3A, the second band 50 comprises a base layer 52 configured for contacting with the user's wrist and a connection layer 54 which is fixed on one side of the base layer 52 in the depth direction away from the user's wrist. The base layer 52 has a width greater than that of the connection layer 54, which facilitates to increase the comfort of the user while wearing the electronic device. Preferably, opposite sides of the base layer 52 extend respectively beyond opposite sides of the connection layer 54 in the width direction. More preferably, opposite sides of the base layer 52 extend respectively beyond opposite sides of the connection layer 54 in the width direction by 1-5 mm, such as 1 mm, 1.5 mm, 2 mm, 2.5 mm, 3 mm, 3.5 mm, 4 mm, 4.5 mm, 5 mm.

Preferably, opposite ends of the base layer 52 extend respectively beyond opposite ends of the connection layer 54 in the length direction, as shown in FIG. 8.

Preferably, the width of the base layer 52 of the second band 50 is equal to that of the base layer 362 of the first band 30.

The second band 50 further comprises a second connection member 56 configured for being connected to the other end of the wearable electronic device 100. The connection layer 54 comprises an end connected to the second connection member 56 and an opposite end connected to the connector 20. The structure of the second connection member 56 may be the same as that of the first connection member 32 and the detailed description about the structure of the second connection member 56 is omitted here.

In some embodiments, the base layer 52 and the connection layer 54 of the second band 50 may be made of cloth, fabric, leather etc. Preferably, the connection layer 54 is made of two layers of cloth which are sewed together. As shown in FIG. 3A and FIG. 8, each of opposite ends of the connection layer 54 is provided with a connecting slot 542. One edge/wall 242 of the second hole 24 of the connector 20 extends through one corresponding connecting slot 542 of the connection layer 54 to thereby connect the second band 50 to the connector 20. The connecting post 562 of the second connection member 56 extends through the other connecting slot 542 of the connection layer 54 to thereby connect the second connection member 56 to the connection layer 54 of the second band 50. The connection portion 564 of the second connection member 56 may be inserted into the other one of the connection grooves 102 (FIG. 1) of the wearable electronic device 10, thereby connecting the second band to the wearable electronic device 10.

Preferably, the ends of the base layer 52 may extend beyond the connecting post 562 and the edge 242 of the second hole 24 of the connector 20 in the length direction of the second band 50. The connection layer 54 has a rectangular shape and four edges of the connection layer 54 are fixed to the base layer 52 by sewing.

In some embodiments, the first hole 22 of the connector 20 has a width substantially equal to that of the base layer 362 of the extension section 36 of the first band 30 such that the extension section 36 with the base layer 362 can extend through the first hole 22. The free end section 34 of the first band 30 has a width less than that of the first hole 22 of the connector 20 which facilitates the free end section 34 of the first band 30 to extend through the first hole 22. The second hole 24 of the connector 20 has a width substantially equal to that of the connection layer 54 of the second band 50. The width of the connection layer 54 of the second band 50 may be equal to that of the fixing layer of the first band 30. The first hole 22 has a width greater than that of the second hole 24.

FIG. 9-FIG. 13B illustrate a watch band connected to a wearable electronic device in accordance with an alternative embodiment. In this embodiment, the wearable electronic device 100' comprises two pairs of spaced lugs 104 arranged at opposite ends thereof. Each lug 104 defines a locking hole 1042. The watch band 10' of this embodiment has a similar structure as the watch band 10 of the above-described embodiment except the connection members. Referring to FIGS. 12A and 12B, each of the first/second connection members 32'/56' of this embodiment is a spring bar which comprises a hollow tube 320, a pair of bars 322 extendable out of opposite ends of the tube 320, a spring 324 compressed between the pair of bars 322. During assembly, the pair of bars 322 can be pressed into the tube 320 and the spring 324 is compressed. After the bars 322 are aligned with the locking holes 1042 of the corresponding lugs 104 of the wearable electronic device 100', the spring 324 will restore to its original shape to push the pair of bars 322 to be engaged into the locking holes 1042 of the corresponding lugs 104 of the wearable electronic device 100'. Preferably, the spring bar further comprises a knob 326 connected to one of the bars 322 and extended out of the tube 320. The knob 326 can be operated to slide together with the bar 322 inward or outward relative to the tube 320, which facilitates to assemble or disassemble the spring bar to or from the wearable electronic device 100'.

The first connection member 32' of the first band 30' is received in the connecting slot 3644 formed at the end of the first band 30'. Specifically, the first band 30' further comprises a connecting section 366 fixed at an end of the base layer 362 away from the free end section. The connecting section 366 comprises a clamping part 3662 for clamping the first connection member 32', a mounting part 3664 for fixing the clamping part 3662 to the base layer 362, and a decoration part 3666 stacked on the fixing part 3664. The connecting slot 3644 is formed at the end of the clamping part 3662. Specifically, the clamping part 3662 is made of two layers stacked together, the two layers are formed by folding a layer of material of the clamping part 3662 and the connecting slot 3644 is formed at the bent/folded area, i.e., the connection area of the two layers of the clamping part 3662. The clamping part 3662 defines an elongated slot to allow the knob 326 to slide therein. The elongated slot is in communication with the connecting slot 3644. In assembly, after the knob 326 is received in the elongated slot of the clamping part 3662 and the tube 320 is received in the connecting slot 3644, free ends of the two layers of the clamping part 3662, the mounting part 3664 and the decoration part 3666 are stacked on the base layer 362 in sequence and fixed on the base layer 362 by sewing. An end of the fixing layer away from the free end section may be sandwiched between the mounting part 3664 and the base layer 362. The two bars 322 are extendable out of opposite ends of the connecting slot 3644. The end of the fixing layer 36 of the first band 30' defines an elongated slot to allow the knob 326 to slide in the slot.

The second connection member 56' is received in the connecting slot 542 formed at the end of the connection layer 54 of the second band 50'. Specifically, the connection layer 54 further comprises a clamping part 544 which has a similar structure as the clamping part 3662. The clamping part 544 is made of two layers stacked together and the connecting slot 542 is formed between the two layers. The clamping part 544 defines an elongated slot to allow the knob 326 to slide therein. The elongated slot is in communication with the connecting slot 542. In assembly, after the knob 326 is received in the elongated slot of the clamping part 544 and the tube 320 is received in the connecting slot 542, free ends of the two layers of the clamping part 544, and a free end of the connection layer 54 away from the connector 20 are stacked on the base layer 52 in sequence and fixed on the base layer 52 by sewing. The two bars 322 are extendable out of opposite ends of the connecting slot 542.

Preferably, the ends of the base layer 52 of the second band 50' may extend beyond the connecting bars 322 and the second hole 24 of the connector 20 in the length direction of the second band 50 respectively. The end of the base layer 52 of the second band 50' away from the connector 20 may extend beyond the second connection member 56'. The end of the base layer 362 of the first band 30' away from the connector 20 may extend beyond the first connection member 32'.

The above embodiments are merely express several implementations of the application, and are specifically described in detail, but they should not be construed as limitations of the patent scope of the application. It should be pointed out that various transformations and improvements can be made by those ordinarily skilled in the art without departing from the concept of the invention, and all these transformations and improvements fall within the protection scope of the application. Thus, the patent protection scope of the application should be defined by the appended claims.

What is claimed is:

1. A watch band, comprising:

a connector comprising a first hole and a second hole arranged at opposite ends thereof;

a first band connected to the first hole of the connector, the first band comprising a first connection member configured for being connected to an end of a wearable electronic device, a free end section and an extension section connected between the first connection member and the free end section; and a second band connected to the second hole of the connector, the second band comprising a second connection member configured for being connected to another end of the wearable electronic device;

wherein the free end section of the first band is extendable through the first hole of the connector to be fastened to the extension section of the first band by hook-and-loop fasteners; and wherein the first hole has a width greater than that of the second hole.

2. The watch band according to claim 1, wherein the free end section of the first band has a width less than that of the extension section.

3. The watch band according to claim 1, wherein the extension section comprises a base layer and a fixing layer for engaging with the free end section, the fixing layer being fixed on a side of the base layer and having a width less than that of the base layer.

4. The watch band according to claim 3, wherein the first band further comprises a connecting section fixed on the base layer and opposite to the free end section, the connecting section defines a connecting slot, and the first connection member extends through the connecting slot.

5. The watch band according to claim 4, wherein the connecting section comprises a decoration part and a clamping part which has two layers stacked together, the connecting slot is formed between the two layers of the clamping part, free ends of the two layers of the clamping part and the decoration part are stacked on the base layer in sequence and fixed to the base layer by sewing, and the first connection member comprises a post which extends through the connecting slot.

6. The watch band according to claim 4, wherein the connecting section comprises a clamping part, a mounting part, a decoration part, the clamping part has two layers stacked together, the connecting slot is formed between the two layers of the clamping part, free ends of the two layers of the clamping part, the mounting part and the decoration part are stacked on the base layer in sequence and fixed to the base layer by sewing, and the first connection member comprises a spring bar which extends through the connecting slot.

7. The watch band according to claim 3, wherein the width of the free end section is substantially equal to or slightly less than that of the fixing layer.

8. The watch band according to claim 3, wherein opposite sides of the base layer extend respectively beyond opposite sides of the fixing layer in a width direction of the first band; or opposite ends of the base layer extend respectively beyond opposite ends of the fixing layer in a length direction of the first band.

9. The watch band according to claim 3, wherein the first hole has a width substantially equal to or greater than that of the base layer of the extension section of the first band.

10. The watch band according to claim 3, wherein the fixing layer is fixed to the base layer by sewing, and the base layer is made of one or more of cloth, nylon, fabric, polyester cotton, dacron and leather.

11. The watch band according to claim 3, wherein opposite sides of the fixing layer in a width direction of the first band are fixed to opposite sides of the base layer by sewing.

12. The watch band according to claim 3, wherein the free end section is provided with loops, and the fixing layer is provided with hooks engageable with the loops.

13. A watch band, comprising:

a connector comprising a first hole and a second hole arranged at opposite ends thereof;

a first band connected to the first hole of the connector, the first band comprising a first connection member configured for being connected to an end of a wearable electronic device, a free end section and an extension section connected between the first connection member and the free end section; and a second band connected to the second hole of the connector, the second band comprising a second connection member configured for being connected to another end of the wearable electronic device;

wherein the free end section of the first band is extendable through the first hole of the connector to be fastened to the extension section of the first band by hook-and-loop fasteners;

wherein the second band comprises a base layer and a connection layer which is fixed on a side of the base layer of the second band and has a width less than that of the base layer of the second band; and the connection layer comprises an end connected to the second connection member and an opposite end connected to the second hole of the connector.

14. The watch band according to claim 13, wherein the extension section of the first band comprises a base layer and a fixing layer fixed on the base layer and configured for engaging with the free end section; and the width of the connection layer of the second band is equal to that of the fixing layer of the extension section of the first band; or the width of the base layer of the second band is equal to that of the base layer of the extension section of the first band.

15. The watch band according to claim 13, wherein the width of the connection layer of the second band is equal to that of the second hole of the connector; or the width of the base layer of the second band is greater than that of the second hole of the connector.

16. The watch band according to claim 13, wherein the base layer and the connection layer both are made of one or more of cloth, nylon, fabric, polyester cotton, dacron and leather.

17. The watch band according to claim 13, wherein the connection layer comprises a pair of connecting slots formed at the end and the opposite end respectively;

the second connection member comprises a connection post extending through one of the connecting slots; and an edge of the second hole extends through the other of the connecting slots.

18. A watch band, comprising:

a band; and a connector configured to connect the band to a wearable electronic device, the connector comprising a hole;

wherein the band comprises a connection member configured for being connected to an end of the wearable electronic device, a free end section and an extension section connected between the connection member and the free end section;

the extension section comprises a base layer and a fixing layer; and the free end section is extendable through the hole of the connector to be fastened to the fixing layer of the extension section;

wherein the fixing layer is fixed on a side of the base layer;

wherein the band further comprises a connecting section fixed on the base layer and opposite to the free end section, the connecting section defines a connecting slot, and the connection member extends through the connecting slot; and wherein the connecting section comprises a decoration part and a clamping part which comprises two layers stacked together, the connecting slot is formed between the two layers of the clamping part, and free ends of the two layers of the clamping part and the decoration part are stacked and fixed on the base layer.

19. The watch band according to claim 18, further comprising another band, wherein the connector further comprises another hole and a pair of side walls extending along a length direction of the watch band, each of the side walls having a curved inner surface for contacting with a user's wrist; and said another band comprises a first end configured to be connected to an opposite end of the wearable electronic device, and a second end connected to said another hole of the connector.

* * * * *